United States Patent [19]

Testa, Jr.

[11] Patent Number: 4,477,972

[45] Date of Patent: Oct. 23, 1984

[54] TOOL FOR USE IN STRIPPING SHINGLES

[75] Inventor: Vincent M. Testa, Jr., Wakefield, Mass.

[73] Assignee: Vinal Realty Trust, Wakefield, Mass.

[21] Appl. No.: 387,975

[22] Filed: Jun. 14, 1982

[51] Int. Cl.[3] ..... A47L 13/02

[52] U.S. Cl. ..... 30/172; 254/131.5

[58] Field of Search ..... 30/172, 169; 254/131.5; 294/58, 54.5

[56] References Cited

U.S. PATENT DOCUMENTS

| | | | |
|---|---|---|---|
| 2,751,192 | 6/1956 | Voortmann | 254/131.5 |
| 3,074,694 | 1/1963 | Erickson | 30/172 X |
| 3,082,554 | 3/1963 | Steeb | 294/58 |
| 3,113,758 | 12/1963 | Knowles | 254/131.5 |
| 3,818,593 | 6/1974 | Oliverius | 30/169 |
| 4,086,699 | 5/1978 | Olkkola | 30/172 |
| 4,203,210 | 5/1980 | Hadlick | 30/172 |

*Primary Examiner*—Jimmy C. Peters

[57] ABSTRACT

A tool, primarily for use in stripping asphalt and wood shingles from a roof, has a flat base plate the front edge of which is provided with a transverse series of teeth and which includes a rearwardly and upwardly extending portion providing a transverse fulcrum. A handle is anchored to the handle and includes a portion spanning the fulcrum zones and anchored to the base plate adjacent the teeth. The handle defines with the base plate an included angle such and the length of which and the shape of which is such that the user can readily force the base plate under a group of shingles and pry them, together with nails, from the roof easily and safely while working from a nearly erect, comfortable position whether the shingles are to be stripped starting from the top of the roof, the eaves, or working from side-to-side of the roof.

8 Claims, 5 Drawing Figures

TOOL FOR USE IN STRIPPING SHINGLES

BACKGROUND REFERENCES

U.S. Pat. Nos. 3,113,758, 4,086,699, 4,203,210.

BACKGROUND OF THE INVENTION

Asphalt and wood shingles covering the roofs of buildings must be removed and replaced from time-to-time to ensure protection against the weather.

The removal of shingles of either type from a roof requires considerable time and effort and is effected by inserting a tool under shingles and then manipulating the tool to pry the shingles loose. While some nails are pulled free along with the shingles, usually with shingles of two or more courses, it is always necessary to make sure that none remains when the new shingles are to be applied.

While a wide variety of tools may be used to remove shingles, it has been long recognized that in prying a group of shingles loose, a tool is more effective with a fulcrum rearwardly of its front edge than it is when the front edge is employed as the fulcrum.

As a consequence, tools have been proposed provided with a properly located fulcrum but these have failed to provide features enabling them to be efficiently used and without the risk of injuries to the hands of users and without undue fatigue.

THE PRESENT INVENTION

The general objective of the invention is to provide a tool, primarily for use in removing wood and asphalt shingles from a roof but useable for other purposes, that is more efficient and safer in use than prior proposals and while of a relatively light weight construction is well adapted to withstand the substantial stresses and strains attendant its use.

In accordance with the invention, this general objective is attained with a tool having a flat base plate the front edge of which is in the form of a transverse series of teeth and which includes an upwardly and rearwardly inclined rear portion establishing a fulcrum. A handle of substantial length is secured to the rear portion of the plate and has an upper rearwardly disposed hand grip, and a front portion bridging the fulcrum and secured to the flat plate adjacent the teeth. The handle defines with the flat plate an included angle of approximately 135° enabling the tool to be used to force the plate under shingles and then depress the handle to pry them loose while the user is standing in a position which is comfortable and can be maintained without being a source of discomfort and excessive fatigue.

A related objective is to provide that the rear portion of the foot plate defines therewith an included angle of approximately 135° and the major portion of the handle is straight and the lower end of the straight portion welded against the upwardly inclined rear portion of the plate and including a forwardly inclined portion which bridges the fulcrum area and is welded to the flat plate adjacent the teeth. The forwardly inclined portion defines an angle of approximately 150° with the straight portion of the handle.

Another objective of the invention is to enable a group of such tools to be stacked, an objective attained by providing the base plate and its rear portion with a slot accommodative of the forwardly inclined handle portion of another tool when the flat base plate is formed with stiffening corrugations to enable it to be formed of relatively thin, light weight sheet metal these do not interfere with nesting.

Yet another objective of the invention is to ensure that the flat plate can be readily forced under the shingles with engaged teeth entered between the teeth, an objective attained with the teeth spaced apart at an angle of 60° and with the base plate tapering inwardly and rearwardly from the outside teeth.

Other objectives, novel features and advantages of the present invention will be apparent from the following description of a preferred embodiment thereof and from the appended claims.

PRIOR ART STATEMENT

The United States patents previously listed are the only prior art known to me that are relevant to the present invention.

Of these, U.S. Pat. Nos. 3,113,758 and 4,203,210 are of interest only because each shows a tool having a fulcrum spaced rearwardly of the edge to be forced under the shingles. The important features of the present invention are neither disclosed or suggested. The latter patent shows a series of teeth included in the front edge of the blade of a space.

U.S. Pat. No. 4,086,699 disclosed a tool more nearly of the type which is the subject of the present invention but fails to show the essential flat base plate, the essential angular relationship of the handle therewith and the structural features previously summarized.

The prior art proposals provide tools that are so nearly straight that when their fulcrums are seated, the handles require the user to operate from uncomfortable, crouched positions with their hands close to the roof.

BRIEF DESCRIPTION OF THE DRAWINGS

The accompanying drawings illustrate a preferred embodiment of the invention

THE PREFERRED EMBODIMENT OF THE INVENTION

Figure 1:
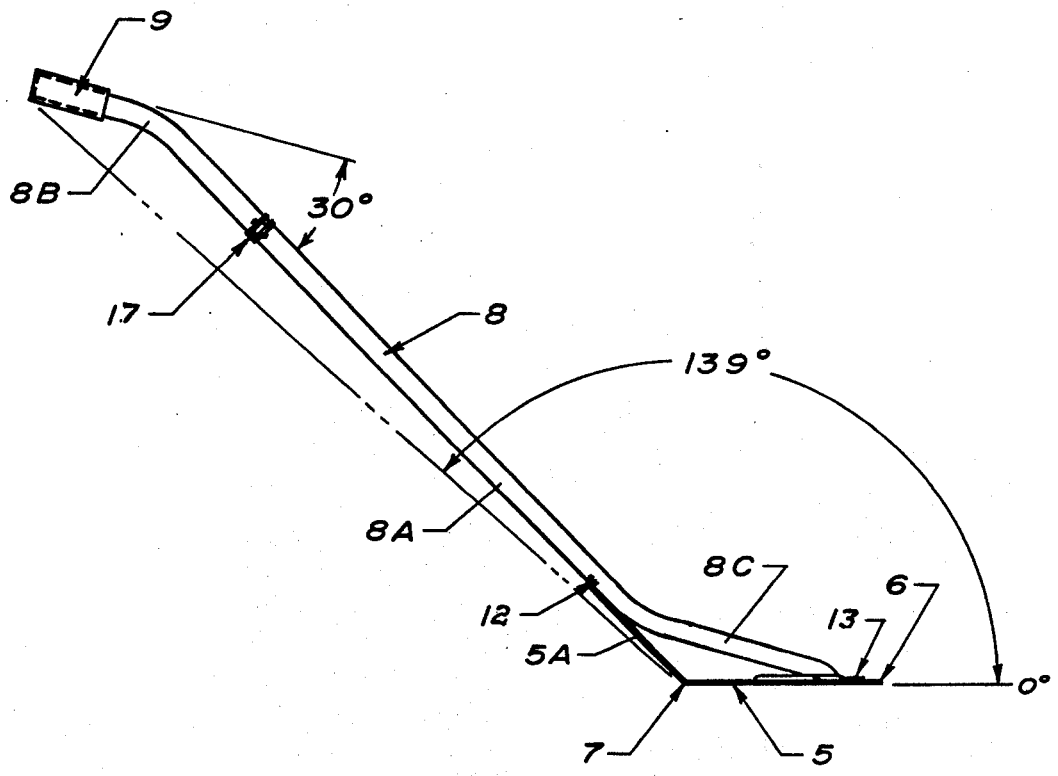
FIG. 1 is a side view of the tool.
Figure 2:
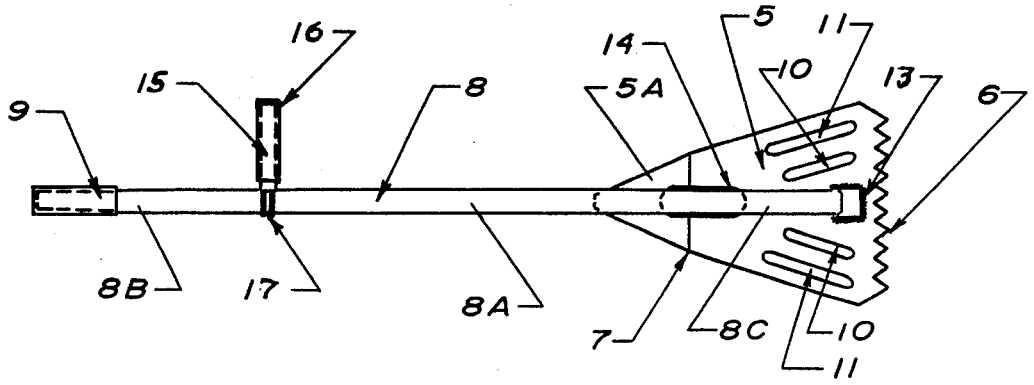
FIG. 2 is a plan view thereof.
Figure 3:
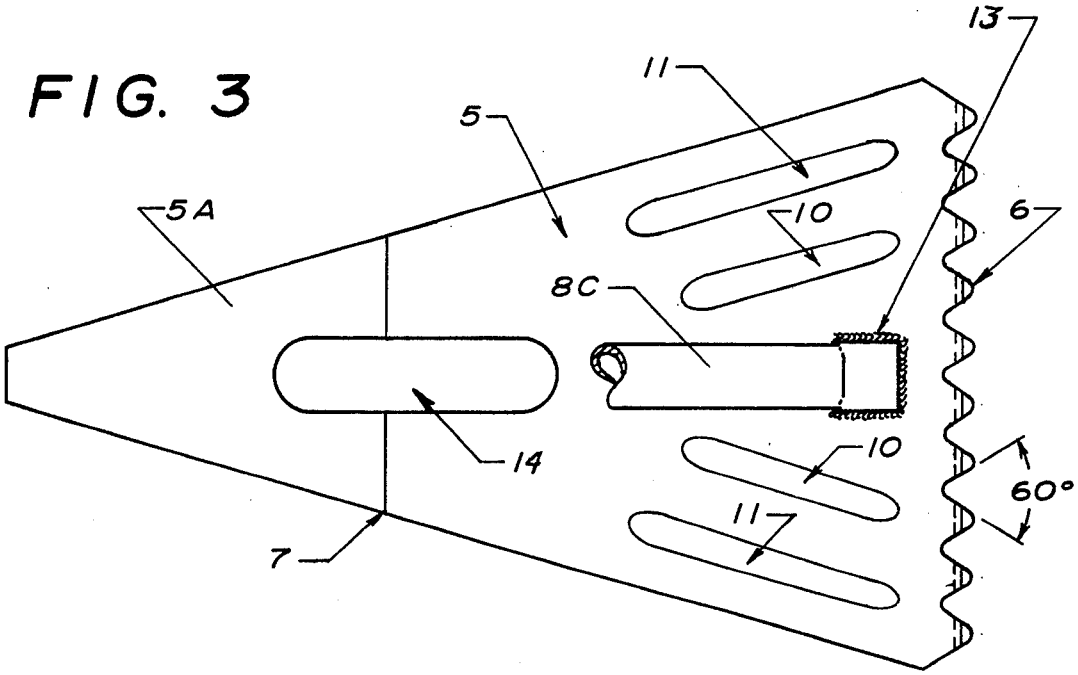
FIG. 3 is a plan view, on a substantial increase in scale, of the flat base plate and portions of the handle.
Figure 4:
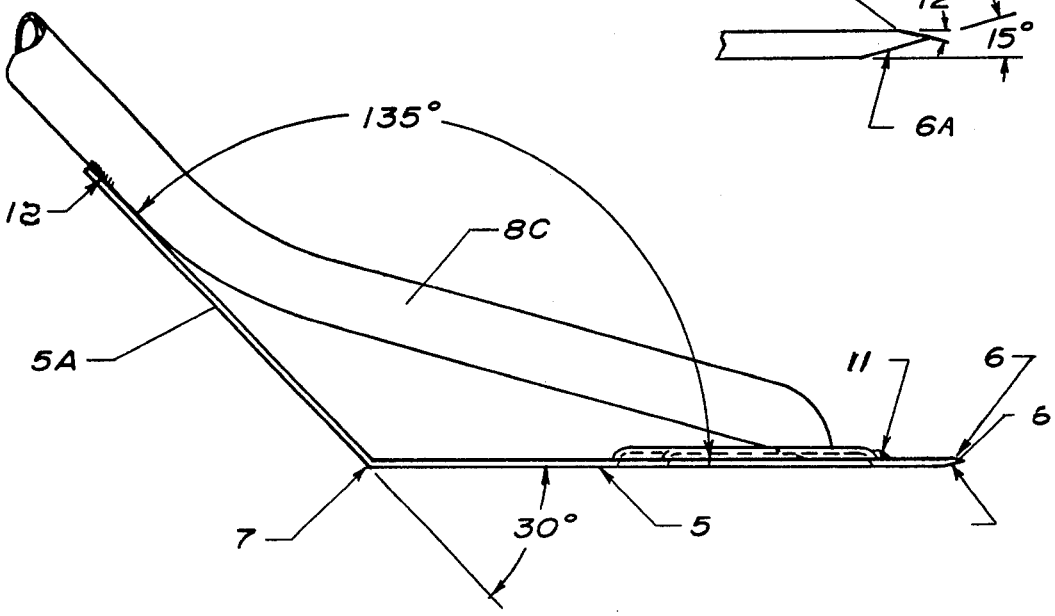
FIG. 4 is a side view of the parts of the tool shown in FIG. 3.
Figure 5:
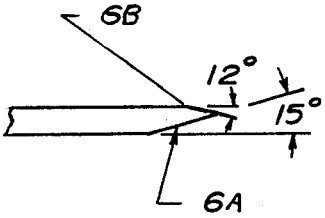
FIG. 5 is a fragmentary view, on an increase in scale of the tip end of a tooth.

The embodiment of the invention illustrated by the drawings has a flat base plate 5 the front edge of which is in the form of a transverse series of teeth 6. The plate 5 includes a rear portion 5A and its sides taper inwardly towards each other so that the base, including its rear portion is a truncated isosceles triangle in shape but the rear portion 5A is bent upwardly to establish a fulcrum, generally indicated at 7 with the included angle established by the rear portion 5A and the flat base plate 5 approximately 135°.

The handle of the tool is generally indicated at 8 and is of tubular metal stock. The handle 8 has a straight main portion 8A and upper, rearwardly inclined handle portion 8B, shown as having a hand grip 9, in practice, a vinyl hand grip with the extremity of the hand grip defining with the plate 5 an included angle of approximately 139° and a lower, forwardly inclined portion 8C defining with the main portion 8A an included angle of approximately 150° with the main portion 8A bridging the fulcrum 7.

The lower or forward end of the handle portion 8A is welded against the upper part of the rear portion 5A of the base plate and the end of the handle portion 8C is welded to the base plate 5 adjacent the teeth 6 and thus bridges the zone of the fulcrum 7. To ensure stiffness of the flat plate 5, it is shown as having corrugations 10 and 11 on both sides of the handle portion 8C and in order to have a substantial length of the handle portion 8A in contact with the rear portion 5A, the length of the rear portion is approximately 60% of the length of the flat plate 5. The weld between the handle portion 8A and the plate portion 5A is indicated at 12 and that between the end of the handle portion 8C and the plate 5 is indicated at 13. In practice, the plate 5 and its rear portion 5A are formed with a central slot 14 to enable the tools to be compactly stacked by accommodating the bridging handle portion 8C of an underlying tool.

In order to ensure maximum ease and convenience in the use of the tool, a side handle 15, in practice provided with a vinyl grip 16, is preferably provided. The handle 15 is threaded on the shank of a ring 17 which encircles the upper end of the handle portion 8A and can be loosened so that it may be shifted from side-to-side or left or right hand engagement.

In use, the flat base plate 5 is forced under the shingles and it will be noted that the fact that the teeth 6 extend from side-to-side of the plate 5 prevents the shearing of nails. The teeth 6 are V-shaped and preferably define angles of 60° with the sides of the base plate tapering rearwardly and inwardly from the base of the outside teeth. Desirably and as shown, the teeth are so dimensioned that they are spaced an inch apart. Desirably and as shown the teeth are rounded as are the junctions between them and the undersurfaces of the tips of the teeth are forwardly and upwardly inclined at a slight angle as at 6A, say 15°, and their upper surfaces are forwardly and downwardly inclined for a short distance as at 6B and at a lesser angle, say 12°.

Once the plate 5 has been forced under shingles, the user depresses the handle and the shingles, usually with all the nails securing them, are pulled free. Because of the angular relation of the handle 8 relative to the flat base plate 5 and because of the length of the handle 8, which in practice is about four and one-half feet in length, the tool may be thus used with the operator in a position that avoids crouching or bending over. The user may start removing shingles from the eaves, which is the conventional starting point, but with tools in accordance with the present invention, he may start from the ridge thus keeping the space behind him clear. The user may also remove shingles working from side-to-side of a roof.

While tools in accordance with the invention are primarily for use in shingle removing, they may also be effectively employed in removing roll roofing, scraping tar and gravel and insulation from flat roofs. They may also be used to remove plaster from wood lathes on walls and ceilings, linoleum and floor tiles, block ceilings, siding, and ice and packed snow.

I claim:

1. A tool for use in removing asphalt and wood shingles from a roof, said tool comprising a foot plate the front portion of which is flat and includes a transverse series of triangular teeth the points and notches between them rounded and an upwardly inclined rear portion, the junction of said portions establishing a transverse fulcrum and a handle of substantial length secured to the rear portion of said foot plate and to the flat front portion adjacent the series of teeth and said handle extending upwardly and rearwardly thereof with the handle and the flat front portion of said foot plate defining an included angle of approximately 135°.

2. The tool of claim 1 in which the handle includes a manually engageable, rearwardly and downwardly extending integral rear end portion in the plane inclusive of the handle.

3. The tool of claim 1 in which the rear portion of the foot plate is upwardly and rearwardly inclined with respect to said front portion to define therewith an included angle of approximately 135°, the handle includes a main, straight portion secured against the forward, flat surface of the rear portion of the foot plate in the plane thereof and a front end portion secured at an acute angle to the front portion of the foot plate and bridging the fulcrum.

4. The tool of claim 3 in which the foot plate between the locations where said handle is secured thereto has an underlying lengthwise slot accommodation of the bridging portion of the handle of another tool when stacked.

5. The tool of claim 2 in which the front portion of the handle defines an included angle with respect to said straight portion of approximately 150°.

6. The tool of claim 5 in which the rear end portion of the handle defines an included angle with respect to said straight portion of approximately 150°.

7. The tool of claim 1 in which the teeth define an angle of approximately 60°.

8. The tool of claim 1 in which the base plate tapers rearwardly and inwardly from the outside teeth.

* * * * *